US005325907A

United States Patent [19]

Nakabayashi et al.

[11] Patent Number: 5,325,907

[45] Date of Patent: Jul. 5, 1994

[54] METALLIC MOLD FOR CASTING VEHICLE WHEEL

[75] Inventors: Shigemitsu Nakabayashi; Yoshimichi Asai; Akihiro Okumura, all of Sayama, Japan

[73] Assignee: Honda Giken Kogyo Kabushiki Kaisha, Tokyo, Japan

[21] Appl. No.: 57,457

[22] Filed: May 7, 1993

Related U.S. Application Data

[63] Continuation of Ser. No. 796,187, Nov. 22, 1991, abandoned.

[30] Foreign Application Priority Data

Nov. 29, 1990 [JP] Japan ..... 2-325777
Mar. 1, 1991 [JP] Japan ..... 3-35804

[51] Int. Cl.[5] ..... B22D 17/06

[52] U.S. Cl. ..... 164/306; 164/DIG. 14; 164/138

[58] Field of Search ..... 164/138, 137, 306, 359, 164/DIG. 14

[56] References Cited

U.S. PATENT DOCUMENTS

| | | | |
|---|---|---|---|
| 4,733,715 | 3/1988 | Matsuzaki et al. | 164/306 |
| 4,834,640 | 5/1989 | Inoue et al. | 164/138 |
| 5,014,768 | 5/1991 | Waters et al. | 164/138 |
| 5,042,562 | 8/1991 | Schilling | 164/234 |

FOREIGN PATENT DOCUMENTS

| | | | |
|---|---|---|---|
| 0041870 | 3/1982 | Japan | 164/138 |
| 0036642 | 2/1985 | Japan | 164/138 |
| 0130767 | 6/1987 | Japan | 164/98 |
| 0089557 | 3/1990 | Japan | 164/306 |
| 2151344 | 6/1990 | Japan . | |
| 1468642 | 3/1989 | U.S.S.R. | 164/138 |
| 2099339 | 12/0882 | United Kingdom . | |
| 1457361 | 12/1976 | United Kingdom . | |
| 2023478 | 1/1980 | United Kingdom . | |

*Primary Examiner*—P. Austin Bradley
*Assistant Examiner*—James Miner
*Attorney, Agent, or Firm*—Armstrong, Westerman, Hattori, McLeland & Naughton

[57] ABSTRACT

A metallic mold for casting a vehicle wheel having openings in a periphery of a disk portion of the wheel comprises a first mold for forming that external side of the wheel which faces an outside of a vehicle when mounted thereon and a second mold for forming an internal side of the wheel. The first mold has those projections for forming the openings which abut the second mold. A high-hardness coating material is coated by electric discharge coating on at least those base portions of the projections which extend diametrically inwards of the wheel, among outer surfaces of the projections. A coating of a mold coating agent is formed on portions of sharp draft in the projections. The coating has a three-layer construction comprising an under coat coated with a mold coating agent consisting essentially of ceramics, a middle coat coated with a mold coating agent consisting essentially of a mixture of boron nitride with ceramics, and a top coat coated with a mold coating agent consisting essentially of titania.

5 Claims, 1 Drawing Sheet

METALLIC MOLD FOR CASTING VEHICLE WHEEL

This application is a continuation of application Ser. No. 07/796,187 filed Nov. 22, 1991, now abandoned.

BACKGROUND OF THE INVENTION

1. Field of the Invention

This invention relates to a metallic mold for casting a vehicle wheel having openings in the periphery of a disk portion thereof.

2. Description of the Related Art

As disclosed in Japanese Published Unexamined Patent Application No. 151344/1990, there is conventionally known a metallic mold which comprises a lower mold, an upper mold and split molds for enclosing the lower and upper molds and in which molten aluminum is filled into a cavity inside the metallic mold by utilizing a gas pressure such as a pneumatic pressure or the like to cast a vehicle wheel by low pressure die casting. In this mold, it is presumed that an external surface which faces the outside when the wheel is actually mounted on a vehicle is formed by the lower mold, that an internal surface of the wheel is formed by the upper mold, and that an outer periphery of a rim portion of the wheel is formed by the split molds, respectively. In order to prevent the external surface of the wheel from giving rise to defects by shrinkage cavities or the like, it is so arranged that the lower mold is water-cooled so that the molten aluminum is solidified from the side of the lower mold, i.e., from the side of the external surface of the wheel.

In addition, it is known, in order to improve the releasing or parting property of the molds and the fluidity of the molten material, to coat the forming surface of each of the molds with a mold coating agent consisting of ceramics.

In case where projections which are used for forming openings and which abut the upper mold are provided on the lower mold in order to form openings such as wind openings which are indented inwards from the external surface in the periphery of the disk portion of the wheel, if the upper mold is cooled later than the lower mold so that the molten material is solidified from the side of the lower mold, the projections trying to be displaced diametrically inwards of the wheel through the shrinkage of the lower mold due to cooling thereof are restricted in their displacement by the upper mold which abuts the projections. As a result, those base portions of the projections which extend diametrically inwards are scratched by the shrinking molten material that shrinks due to solidification, and the mold coating agent of those portions is likely to be peeled off. This results in an increased coating frequency of the mold coating agent and a consequent poor productivity.

SUMMARY OF THE INVENTION

In view of the above disadvantage, this invention has an object of providing a metallic mold for coating in which the durability of the coating to be provided on the base portions of the projections is increased and the frequency of coating the mold coating agent is decreased, thereby improving the productivity.

In order to attain the above-described object, according to this invention, there is provided a metallic mold for coating a vehicle wheel having openings in a periphery of a disk portion of the wheel, the metallic mold comprising: a first mold for forming that external side of the wheel which faces an outside of a vehicle when mounted thereon; a second mold for forming an internal side of the wheel; the first mold having projections for forming the openings and the projections abutting the second mold; wherein a coating material is coated by electric discharge coating on at least those base portions of the projections which extend diametrically inwards of the wheel, among outer surfaces of the projections.

Since the coating on the base portions of the projections is formed by electric discharge coating, the adhesive force for the coating to adhere to the metallic mold is strong. Therefore, even if the base portions are scratched by the shrinking molten material, the coating does not easily peel off and the durability of the coating is improved. As the coating material, tungsten carbide and titanium carbide which have high hardness as well as heat resisting property and good lubricating property are suitable.

In case where projections are provided, the draft, i.e., the taper given to the mold, becomes steep. Consequently, gnawing (i.e., wearing away or removing a part as if by erosion or corrosion) is likely to occur, at the time of parting the mold, to give scratches to the opening portions. In this case, it is preferable to coat those portions of sharp draft of the projections with a mold coating agent consisting essentially of ceramics. However, since the molten material solidifies tight enough around the projections, the coating of the mold coating agent is likely to be peeled off at the time of parting the mold. It is thus not possible to effectively prevent the gnawing by the projections. As an alternative solution, it can also be considered to coat the portions of the sharp draft of the projections with the coating material of high-hardness in the same manner as in the base portions. However, this results in high costs.

Therefore, according to another feature of this invention, a coating of a mold coating agent is formed on those portions of sharp draft in the projections, the coating having a three-layer construction comprising an under coat coated with a mold coating agent consisting essentially of ceramics, a middle coat coated with a mold coating agent consisting essentially of a mixture of boron nitride with ceramics, and a top coat coated with a mold coating agent consisting essentially of titania.

Boron nitride which is contained in the middle coat is in the shape of scales and has a good lubricating property. On the other hand, titania, which is contained in the top coat, has a good heat resisting property and a high hardness. The middle coat and the top coat help each other in improving both the ease with which the molds can be released and the durability of the coat.

It is preferable to form the top coat such that the cavities among the particles on the surface of the middle coat are filled. Therefore, the top coat is formed by brushing while the base coat and the middle coat are formed by spray coating.

BRIEF DESCRIPTION OF THE DRAWINGS

The above and other objects and the attendant advantages of this invention will become readily apparent by reference to the following detailed description when considered in conjunction with the accompanying drawings wherein.

DETAILED DESCRIPTION OF A PREFERRED EMBODIMENT

Figure 1:
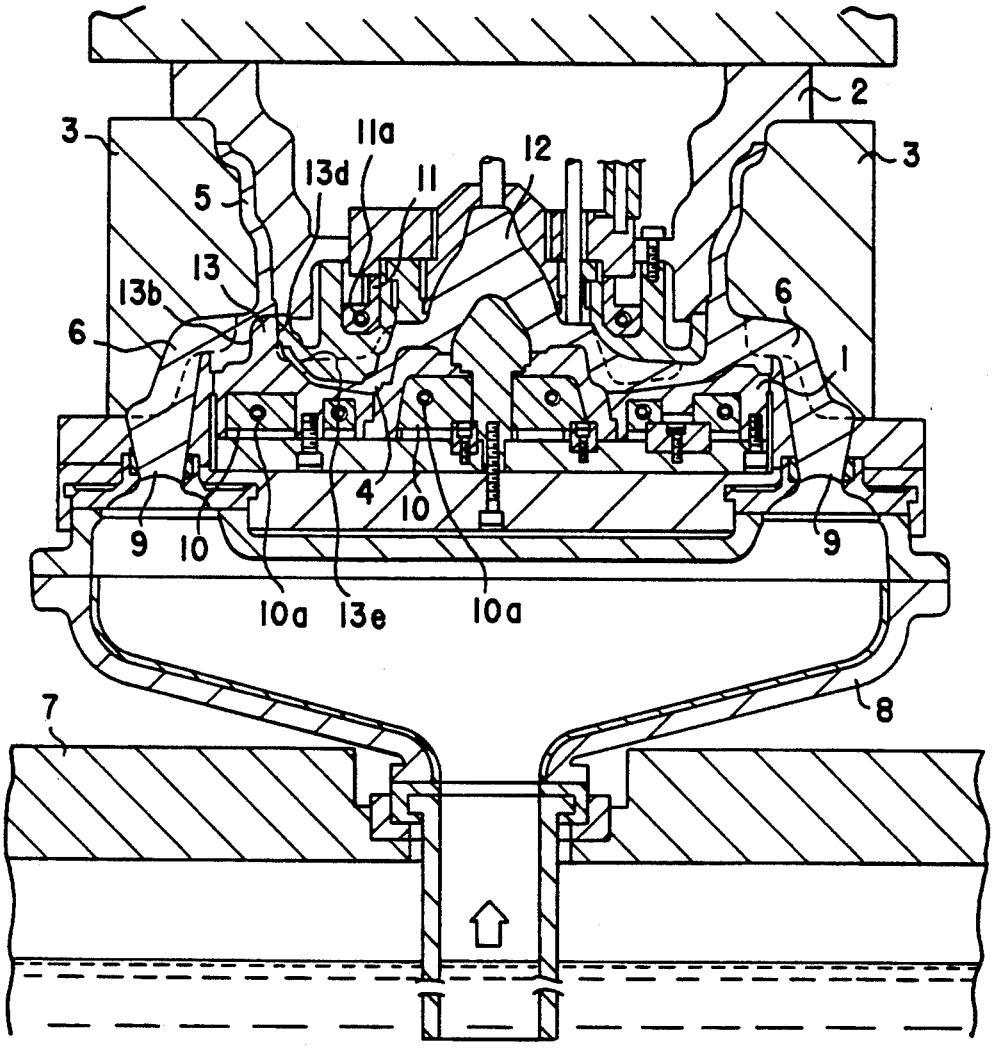
FIG. 1 is a longitudinal sectional view of an example of a metallic mold according to this invention.

FIG. 1 is a metallic mold for casting a vehicle wheel. The metallic mold is made up of a lower mold 1, an upper mold 2 which is movable up and down, and a plurality of split molds 3 which are horizontally slidable to enclose the molds 1 and 2. By mold clamping through the lowering of the upper mold 2, a cavity 4 for casting a disk portion of the wheel is formed between the upper mold 2 and the lower mold 1. By mold clamping through the lateral inward sliding movement of the split molds 3, another cavity 5 for casting a rim portion of the wheel is formed between the upper and lower molds 1, 2 and the split molds 3.

In the split molds 3 there is provided a poring gate 6 which is in communication with the cavity 5 for the rim portion. Molten aluminum which is held in a molten material holding furnace 7 provided under the lower mold 1 is fed to the poring gate 6 through a molten material feeding pipe 8 and a runner 9 formed in the lower mold 1 by means of a pneumatic pressure to be applied to the furnace 7. The molten aluminum is fed to the cavities 4, 5 from the poring gate 6 to thereby cast the wheel by low pressure die casting. In this embodiment, the lower mold 1 casts that external surface of the wheel which faces the outside when the wheel is actually mounted on the vehicle. The lower mold 1 has buried therein chillers 10 having cast therein cooling water pipes 10*a*. The upper mold 2 has buried therein chillers 11 having cast therein cooling air pipes 11*a*. The cooling capacity of the lower mold 1 is made to be higher than that of the upper mold 2. In addition, the upper mold 2 is provided with a riser portion 12. It is thus so arranged that the molten aluminum inside the cavity 4 is solidified from the side of the lower mold 1, i.e., from the external surface of the wheel so that there will occur no defects such as shrinkage cavities or the like on the external surface.

Figure 2:
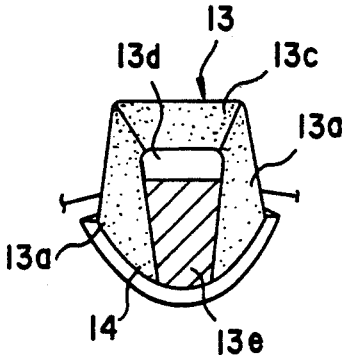
FIG. 2 is a perspective view of a projection for forming an opening.

In the lower mold 1, there are provided projections 13 for forming openings such as wind openings which are indented inwards from the external surface in the periphery of the disk portion, as shown in FIG. 2. On both side surfaces 13*a*, 13*a*, the diametrically outside periphery surface 13*b* and the top surface 13*c* of each projection, there are formed coatings 14 of a mold coating agent. Each projection 13 abuts the upper mold 2 at a rising surface 13*d* on the diametrically inside upper periphery of the projection 13 so that the projection 13 is restricted in its diametrically inward displacement accompanied by the cooling of the lower mold 1. An inwardly extending base portion 13*e* at the diametrically inside lower periphery of each projection 13 is consequently scratched by the shrinking molten aluminum that shrinks accompanied by its solidification. Therefore, the base portion 13*e* is coated with a high-hardness coating material which consists essentially of tungsten carbide, titanium carbide, or the like by means of electric discharge coating.

Figure 3:
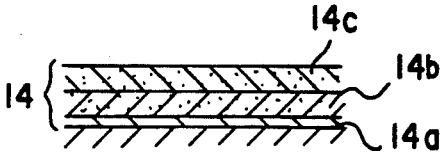
FIG. 3 is a schematic sectional view of a coat of a mold coating agent.

Each of the foregoing coatings 14 is made up, as shown in FIG. 3, of a three-layer construction which comprises an under coat 14*a*, a middle coat 14*b* and a top coat 14*c*. The under coat 14*a* is formed by spraying a mold coating agent which consists essentially of ceramics. The middle coat 14*b* is formed by spraying a mold coating agent which consists essentially of a mixture of ceramics and boron nitride (BN). The top coat 14*c* is formed by brushing a mold coating agent which consists essentially of titania ($TiO_2$).

Examples of the compositions, in % by weight, of these mold coating agents are given hereinbelow. The agent for the under coat 14*a* consists of 30–40% of $SiO_2$, 20–30% of $Al_2O_3$, 5–10% of $ZrO_2$, 10–20% of $Na_2O$ and the remaining part of $H_2O$. The agent for the middle coat 14*b* consists of 30–50% of $SiO_2$, 5–10% of MgO, 5–10% of $Al_2O_3$, 20–30% of BN, and the remaining part of $H_2O$. When the BN content becomes less than 20%, while the coating strength is improved, the sliding property becomes poor and, consequently, gnawing by the projection is likely to occur. If, on the other hand, the BN content becomes more than 30%, peeling-off of the coating is likely to occur, resulting in a lowered durability. Therefore, it is preferable to keep the mixing ratio of BN to 20–30%. As the agent for the top coat 14*c*, the one consisting essentially of $TiO_2$ with a mixture of paraffin, graphite, linseed oil, surface active agent and kerosene, is used.

Explanation will be made hereinbelow about the tests using the metallic mold of this invention.

In a condition in which the mold temperature was maintained at 190°–215° C., the sandblasted surfaces 13*a*, 13*b*, 13*c* of the projection 13 were coated by spraying with a mold coating agent consisting of 35% of $SiO_2$, 25% of $Al_2O_3$, 7.5% of $ZrO_2$, 15% of $Na_2O$ and 17.5% of $H_2O$ to such a thickness that the substrate is vaguely visible. Then, the under coat 14*a* was burned by changing the mold temperature to 220° C. Thereafter, in a condition in which the mold temperature was maintained at 230° C., a mold coating agent consisting of 40% of $SiO_2$, 7.5% of $MgO_2$, 7.5% of $Al_2O_3$, 25% of BN and 20% of $H_2O$ was coated by spraying to a thickness of 0.1 to 0.15 mm. Then, the mold temperature was changed to 240° C. to burn the middle coat 14*b*. Finally, in a condition in which the mold temperature was maintained at 240° C., the above-described agent consisting essentially of $TiO_2$ was coated by brushing to a thickness of 0.15 mm. The mold temperature was raised to 350° C. to burn the coat for 20 minutes or more, thereby forming the three-layer construction of coating 14 on each of the surfaces 13*a*, 13*b*, 13*c* of the projection 13. In addition, the base portion 13*e* of the projection 13 was coated by electric discharge coating with tungsten carbide. An example of metallic mold according to this invention was prepared by the above steps. A comparative example of metallic mold was prepared by coating by spraying each of the surfaces 13*a*, 13*b*, 13*c*, as well as the base portion 13*e* of the projection 13 with a coating agent which has the same composition as that of the under coat of this invention to form a coating of 0.15 mm thick.

Vehicle wheels were cast using the example of metallic molds of this invention and the comparative example. The result was that no roughened surfaces due to gnawing were recognized with the example of this invention even after about 670 shots of casting while, with the comparative example, roughened surfaces were recognized in the periphery of the openings in about 40 shots of casting.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A metallic mold for casting a vehicle wheel having openings in a periphery of a disk portion of the wheel, said metallic mold comprising:

a first mold for forming that external side of said wheel which faces an outside of a vehicle when mounted thereon;

a second mold for forming an internal side of said wheel;

said first mold having projections for forming said openings and said projections abutting said second mold;

wherein a coating material consisting of tungsten carbide is selectively coated by electric discharge coating on at least base portions which extend diametrically inwards of said wheel, among outer surfaces of said projections.

2. A metallic mold for casting a vehicle wheel having openings in a periphery of a disk portion of the wheel, said metallic mold comprising:

a first mold for forming that external side of said wheel which faces an outside of a vehicle when mounted thereon;

a second mold for forming an internal side of said wheel;

said first mold having projections for forming said openings and said projections abutting said second mold;

wherein a coating material consisting of titanium carbide is selectively coated by electric discharge coating on at least base portions which extend diametrically inwards of said wheel, among outer surfaces of said projections.

3. A metallic mold for casting a vehicle wheel having openings in a periphery of a disk portion of the wheel, said metallic mold comprising:

a first mold for forming that external side of said wheel which faces an outside of a vehicle when mounted thereon; and a second mold for forming an internal side of said wheel, wherein said first mold includes projections for forming said openings and said projections abutting said second mold, wherein a coating material is coated by electric discharge coating on at least base portions which extend diametrically inwards of said wheel, among outer surfaces of said projections, wherein a coating of a mold coating agent is formed on portions of sharp draft in said projections, wherein said coating of a mold coating agent has a three-layer construction comprising an under coat coated with a mold coating agent consisting essentially of ceramics, a middle coat coated with a mold coating agent consisting essentially of a mixture of boron nitride with ceramics, and a top coat coated with a mold coating agent consisting essentially of titania.

4. A metallic mold according to claim 3, wherein said under coat and said middle coat are coated by spraying and said top coat is coated by brushing.

5. A metallic mold according to claim 3 or 4, wherein a mixing ratio of boron nitride in said mold coating agent in said middle coat is 20 to 30% by weight.

* * * * *